United States Patent [19]

Lechler

[11] 4,117,907

[45] Oct. 3, 1978

[54] DEVICE FOR ASPIRATION OF LUBRICATING OIL FROM THE SUPPLY OF A COMBUSTION ENGINE

[75] Inventor: Rolf Lechler, Neckarsulm, Fed. Rep. of Germany

[73] Assignee: Audi Nsu Auto Union Aktiengesellschaft, Neckarsulm, Fed. Rep. of Germany

[21] Appl. No.: 752,200

[22] Filed: Dec. 20, 1976

[30] Foreign Application Priority Data

Dec. 22, 1975 [DE] Fed. Rep. of Germany ..... 2557888

[51] Int. Cl.[2] ..... F01M 11/00

[52] U.S. Cl. ..... 184/6.2; 123/196 CP

[58] Field of Search ..... 123/196 R, 196 CP, 196 S; 184/6.7, 7 R, 6.4, 6.2

[56] References Cited

U.S. PATENT DOCUMENTS

| | | | |
|---|---|---|---|
| 1,845,136 | 2/1932 | Dieter | 184/6.2 |
| 2,239,098 | 4/1941 | Hunter | 184/6.2 |
| 2,332,007 | 10/1943 | Parker | 184/6.2 |
| 3,554,322 | 1/1971 | Deutschmann | 184/6.2 |
| 3,590,953 | 4/1969 | Wellaner | 184/6.2 |

*Primary Examiner*—Charles J. Myhre
*Assistant Examiner*—David D. Reynolds
*Attorney, Agent, or Firm*—Kane, Dalsimer, Kane, Sullivan & Kurucz

[57] ABSTRACT

A device for aspiration of lubricating oil from the supply of a combustion engine that may at times be moved out of a normal position into a different position, in particular an upside-down position, by means of a lubricant pump delivering the oil to the bearing surfaces of the engine.

3 Claims, 6 Drawing Figures

DEVICE FOR ASPIRATION OF LUBRICATING OIL FROM THE SUPPLY OF A COMBUSTION ENGINE

BACKGROUND OF THE INVENTION

Devices have been provided in combustion engines serving, for example, as power plants of aircraft, in order to maintain supply of lubricant to the engine when the attitude of the aircraft varies, and especially in upside-down attitudes.

There is a known system of maintaining dependable lubricant supply in which a plurality of oil pumps are arranged in the engine, with the oil to be delivered by that pump whose point of intake is immersed in the oil supply, being according to the tilt of the engine. This pump must then first deliver the oil to a reservoir to which another oil pump is connected, which finally delivers the oil to the lubricating circuit of the engine. In this known arrangement, however, the multiplicity of oil pumps required entails added cost. Besides, much space is required to accomodate the pumps, and the system is costly and trouble-prone owing to its complicated structure.

There is another known system in which at least one pivoted pendulum member in at least one special housing is provided, having a point of intake that will be immersed in the oil by gravity in every attitude of the engine to thus maintain the lubricant supply. While this arrangement requires only one oil pump, the rigging of the pendulum member likewise calls for a comparatively large structural and spatialoutlay, involving added cost. The systems mentioned moreover require additional precautions to prevent aspiration of air into the oil line.

Apart from these various systems, however, it is found in practice that the lubricating oil present in aviation combustion engines is always acted upon centrifugal force in most unusual flight attitudes, with the exception of the upside-down attitude; even, that is in steep banks and oblique attitudes as well as in helical maneuvers. This means that the oil supply, ordinarily contained in a lower storage tank is subject to such minor fluctuations that the lubricant supply to such an engine is safely maintained in the said flight attitude. The gravitational force acting on the lubricant is not much modified unless the engine remains in upside-down position with sustained deceleration, as is possible in stunt flying for example. For such a rare and extreme case, the known devices are too elaborate and costly in design.

SUMMARY OF THE INVENTION

The object of the invention is to maintain the lubricant supply of an internal combustion engine in simple manner and with little outlay, even in an upside-down position.

This object is accomplished according to the invention by providing at least two supply tanks one of which is intended to hold the oil supply in the normal attitude and the other is intended to hold the oil supply in a different attitude of the engine. These tanks are capable of being connected to the suction side of the oil pump by way of one return line each, with a valve responding to gravity being provided, which in one attitude of the engine brings the return like of the tank associated with the attitude into communication with the suction side of the pump and shuts off the return line of the other pump.

Through this arrangement, a constant connection can be maintained between the lubricant pump and the oil supply, while the valve, which like the oil itself is acted upon by gravity and any centrifugal forces, automatically establishes a connection with one of the tanks according to the attitude of the engine, while the connection to the other tank can be shut off against any aspiration of air.

The one tank, accomodating the supply in the normal attitude, may be arranged beneath the engine, and the other tank on the opposed side above the engine, and the valve may be arranged between the suction side of the oil pump on the one hand and the two return lines connected to the tanks on the other hand. Such an arrangement has the advantage that with comparatively small structural outlay and space requirements, the system will maintain the lubricant supply to the engine even in an upside-down position.

The valve may consist of a slide arranged in a housing and displaceable by gravity between two operating positions, and at right angles to the longitudinal axis of the engine. In the housing, a first port communicates with the return line of the bottom tank, a second port communicates with the return line of the top tank. A third opening communicates with the suction side of the oil pump and may be so arranged that in the first operating position, corresponding to a normal attitude, the first port is connected with the third while the second port is closed off by the slide, and in the second operating position corresponding to an upside-down attitude the second port is connected with the third while the first port is closed off by the slide. By this arrangement, the proper connection between the two tanks and the pump can be simply and dependably controlled according to the attitude of the engine.

Specifically, the valve may be constructed with the slide cylindrical and arranged in a cylindrical bore of the housing, with the first and second ports being in the wall of the cylindrical bore and the third port in the end of the cylindrical bore. The slide is provided with a longitudinal bore and lateral passage slits connecting the outer surface of the slide with the longitudinal bore. These slits enable a connection to be made either between the third and first or between the third and second ports.

Examplary embodiments of the invention as well as other details and features will be further described in the following with reference to the drawings.

DETAILED DESCRIPTION

Figure 1:
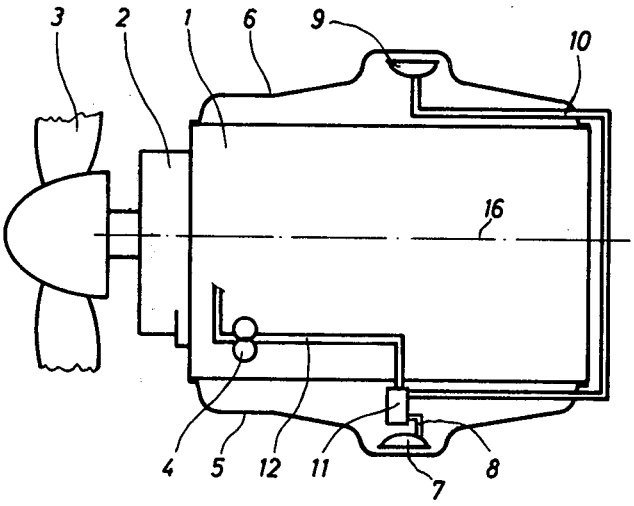
FIG. 1 is a schematic view showing the general arrangement of a device for aspirating lubricant from the supply of an internal combustion engine.

Reference is made initially to FIG. 1 schematically showing the general arrangement of the device in accordance with this invention in a combustion engine 1 employed as the power plant of an aircraft. For this purpose, a reducing gear 2 is flanged to one end of the engine 1 to drive a propeller 3, only a portion of which is shown. To lubricate the engine 1 an oil pump 4 is provided. Underneath the engine 1 a tank 5 is arranged to hold the oil supply in the normal attitude, and above the engine 1 on the opposed side another tank 6 is arranged to hold the oil supply in the inverted attitude of the engine, the top tank 6 consisting, for example, of a valve cover. In the bottom tank 5 and from intake 7 a return line 8 leads to a valve 11 as does a return line 10 from intake 9. The two lines 8 and 10 may be connected to the suction line 12 of the oil pump 4 by means of valve 11. the valve 11 is designed to respond to gravity and in the position shown corresponding to a normal attitude, it connects the suction line 12 of pump 4 by way of line 8 and intake 7 to the bottom tank 5, while the line 10 of the top tank 6 is shut off. Thus, in this position the supply of oil is maintained from the tank 5 while aspiration of air from the top tank 6 is prevented. In an inverted position or upside-down attitude of the engine 1, the top tank 6 is lowermost, so that oil escaping from the points of lubrication of engine 1 will collect by gravity in tank 6. In this position, gravity acts on the valve 11, the suction line 12 of pump 4 is connected by way of line 10 and intake 9 to tank 6, while line 8 is closed to prevent air from being aspirated through said line 8, since in that case the suction line 7 is not immersed in oil.

Figure 2:
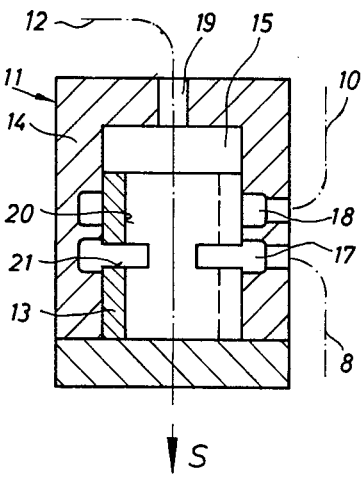
FIG. 2 shows a longitudinal section of a valve for the device of FIG. 1 in one of its operating positions.

FIG. 2 shows a simplified representaton of a valve 11. It consists essentially of a cylindrical slide 13 arranged in a cylindrical bore 15 of a housing 14, displaceable lengthwise between two operating positions and perpendicular to the longitudinal axis 16 of the engine 1 as indicated in FIG. 1. In the wall of the cylindrical bore 15 is arranged a first port 17 in the form of an annular groove to which return line 8 is connected, leading to the bottom tank 5 shown in FIG. 1. In the cylindrical bore 15 and offset upwardly is a second port 18 likewise in the form of an annular groove, to which is connected the line 10 leading to the top tank 6. In the top end of bore 15, a third port 19 is provided, communicating with the suction line 12 leading to the pump 4. The slide 13 has a longitudinal bore 20 and lateral passage slits 21 connecting the outer surface of the slide 13 with the longitudinal bore 20.

In the first operating position shown corresponding to a normal attitude, in which gravity acts in the direction indicated by the arrow S, the slide 13 connects the first port 17 with the third port 19, while the second port 18 is shut off by the outer surface of the slide 13. This initially establishes a connection from line 8 to suction line 12 for passage of lubricant and secondly prevents aspiration of air from tank 6.

Figure 3:
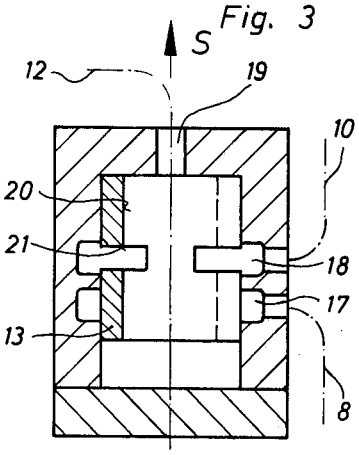
FIG. 3 shows the valve of FIG. 2 in another operating position.

As shown in FIG. 3 gravity S acts on the valve 11 in the opposed direction corresponding to the second operating position in upside-down attitude. The position of the housing 14 has been left to better illustrate the setting of the slide 13. In reality, however, the port 19 of housing 14 would point downward. In this position the slide 13 connects the second port 18 to the third port 19 while the outside surface of the slide 13 shuts off the first port 17. Thus, the flow of lubricant from the other line 10 into the suction line 12 is released and air cannot be aspirated from tank 5.

Figure 4:
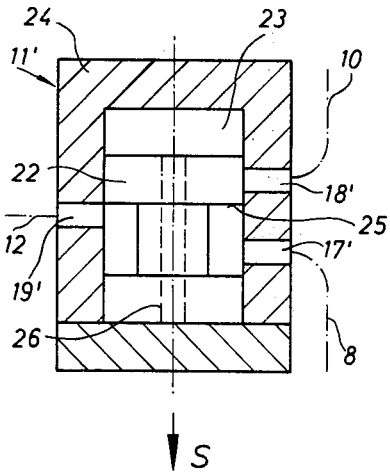
FIG. 4 shows another embodiment of a valve similar to that of FIG. 2 occupying one operating position.

The valve 11′ shown in FIG. 4 consists essentially of a cylindrical slide 22 arranged longitudinally displaceable between two operating positions as in the embodiment of FIGS. 2 and 3 in a cylindrical bore 23 of a housing 24. This valve 11′ is likewise perpendicular to the longitudinal axis 16 of the engine 1. In the wall of the cylindrical bore 23 a first port 17′ is provided, to which is connected the line 8 of the bottom tank 5. To a second port 18′ opening into the bore 23 is connected the return line 10 for the top tank 6. Between ports 17′ and 18′ on the opposed side of the bore 23, a third port 19′ is provided connected to the suction line 12 leading to the pump 4. The slide 22 has an annular groove 25 by way of which in the first operation position shown, corresponding to a normal attitude the first port 17′ is connected with the third port 19′, permitting flow of lubricant from the line 8 of the bottom tank 5 through valve 11′ to the suction line 12 of pump 4. On the other hand, the port 18 is shielded by the outer surface of slide 22 against any aspiration of air from the top tank 6.

Figure 5:
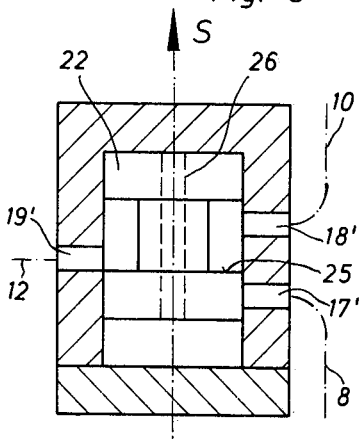
FIG. 5 shows the valve of FIG. 4 in another operating position.

In the valve 11′ of FIG. 4 as shown in FIG. 5, gravity S acts in the opposed direction, bringing the slide 22 into its second operating position corresponding to the inverted attitude of the engine. As a result the annular groove 25 and ports 18′ and 19′ establish a connection between the line 10 of the top tank 6 and the suction line 12 of pump 4, while port 17′ is shut off against any aspiration of air by the outer surface of slide 22. The axial equalizing passage 26 in slide 22 serves the purpose of permitting exchange of medium present above and below slide 22 to ensure ease of travel of slide 22 in the bore 23.

Figure 6:
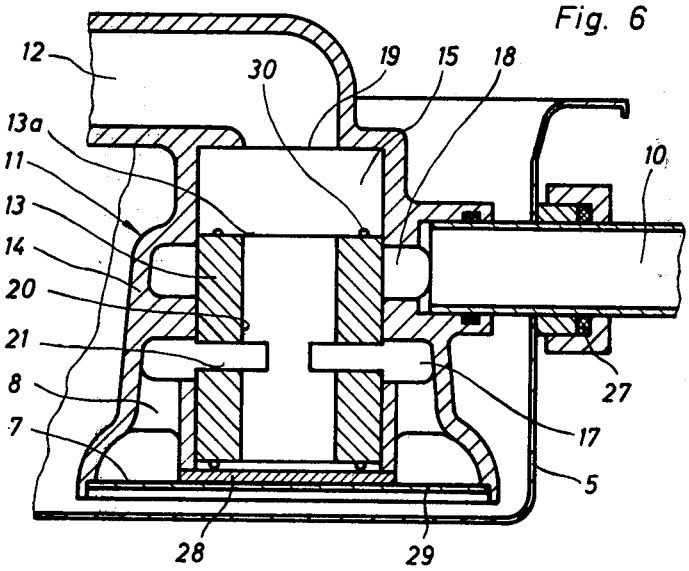
FIG. 6 shows the valve of FIGS. 2 and 3 in further detail.

FIG. 6 shows a preferred embodiment of valve 11 performing the function of the valve of FIGS. 2 and 3 and accordingly bears the same reference numerals. This embodiment is distinguished by a compact, space-saving construction, the intake 7 and line 8 having been incorporated in the housing 14. The line 10 leading to the top tank 6 passes out of the bottom tank 5 through a stuffing box 27. The bore 15 is closed off at the bottom by a cover 28 with inclusion of an oil screen 29 for the intake 7. The slide 13 is provided on both faces 13*a* with small elevations 30 preventing direct contact and consequent adhesion to the ends of bore 15. Also, the distance between the annular grooves of ports 17 and 18 is greater than the width of the passage slit 21 to ensure ease of travel of slide 13 in bore 15. Due to the geometry of the ports and slit, flow from one tank is positively shut off so long as there is a connection with the other tank via lines 8 or 10.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A lubrication system for the bearings of a combustion engine moved on occasion from a normal position into a different position, comprising at least two oil supply tanks, one for the supply in the normal position and the at least one other for the supply in the different position, an oil pump having a delivering line for delivering oil to the engine bearings and a suction line connected via a gravity valve with said tanks, said gravity valve having a valve body with a first end position corresponding to said normal position, in which the connection with the tank associated with said normal position is opened and the connection with the other tank is shut off, and a second end position corresponding to said different position in which the connection with the tank associated with said different position is opened and the connection with the other tank is shut off, whereby during the travel of said valve body from one end position to the other the connection with one tank is positively shut off as long as there is a connection with the other tank.

2. A lubrication system according to claim 1 wherein said valve body is a slide arranged in a cylindrical bore of a housing, said bore having longitudinally spaced ports connected to the one and the at least one other tank, respectively, and being connected to the suction line of the pump; said slide having a longitudinal bore and a lateral passage slit connecting the outer surface of the slide with the longitudinal bore, said slit communicating the one or the at least one other of said ports with said longitudinal bore in the first or second end position, wherein the distance between said ports is greater than the width of said slit so that said slit is never in communication with both ports simultaneously.

3. A lubrication system according to claim 1 wherein the one tank accomodating the supply in the normal position is arranged below the engine and the at least one other tank on the opposed side above the engine.

* * * * *